US007273293B2

(12) United States Patent
Dalton et al.

(10) Patent No.: US 7,273,293 B2
(45) Date of Patent: Sep. 25, 2007

(54) RECHARGABLE FLASHLIGHT

(75) Inventors: David R. Dalton, Turramurra (AU); Michael Squires, Ryde (AU); Kw Au, Kowloon (CN); David J. Alessio, Amherst, OH (US); Siu Bong Ng, Hong Kong (CN)

(73) Assignee: Eveready Battery Company, Inc., St. Louis, MO (US)

( * ) Notice: Subject to any disclaimer, the term of this patent is extended or adjusted under 35 U.S.C. 154(b) by 149 days.

(21) Appl. No.: 10/505,913

(22) PCT Filed: Dec. 31, 2002

(86) PCT No.: PCT/AU02/01751

§ 371 (c)(1),
(2), (4) Date: Mar. 21, 2005

(87) PCT Pub. No.: WO03/074930

PCT Pub. Date: Sep. 12, 2003

(65) Prior Publication Data

US 2005/0162848 A1 Jul. 28, 2005

(30) Foreign Application Priority Data

Mar. 1, 2002 (AU) ..... PS 0850

(51) Int. Cl.
*F21L 4/08* (2006.01)

(52) U.S. Cl. ..... 362/183; 362/194; 320/114

(58) Field of Classification Search ..... 362/183, 362/200, 203, 205, 208, 194; 320/114, 115
See application file for complete search history.

(56) References Cited

U.S. PATENT DOCUMENTS 6,752,514 B2 * 6/2004 Parker ..... 362/183

* cited by examiner

*Primary Examiner*—Alan Cariaso
*Assistant Examiner*—Leah S Lovell
(74) *Attorney, Agent, or Firm*—Gregory J. Adams

(57) ABSTRACT

The present invention provides a flashlight having a body with a light means at one end, a battery, and a circuit therebetween, so that when said circuit is closed said light means will generate light; recharging terminals for recharging said battery and an adaptor having electrical connectors for connecting to a power supply; structural connection means on said body and or said adaptor to releasably connect said body and said adaptor; and electrical connection means on both said body and said adaptor to releasably electrically connect said terminals and said adaptor.

The present invention also provides a flashlight having a body with a light means at one end, a battery, and a circuit therebetween, so that when said circuit is closed said light means will generate light; said light means including a conical reflector, a white light LED emitting a conical light output and a double convex lens portion, said double convex lens portion being located away from said LED so that the outside diameter of said double convex lens portion will a circle of light from said LED which is of substantially the same diameter.

28 Claims, 10 Drawing Sheets

RECHARGABLE FLASHLIGHT

FIELD OF THE INVENTION

The present invention relates to rechargeable flashlights, their use and operation.

BACKGROUND OF THE INVENTION

Rechargeable flashlights have been known for a considerable time. Disclosed in U.S. Pat. No. 5,847,540 is a rechargeable flashlight having a plug unit supported in the flashlight housing for rotation between a non-charging position, in which blades of the plug unit are retracted into the housing, and a charging position in which the blades are projecting from the housing for insertion into an AC outlet. The plug unit cooperates with a switch unit in the housing for connecting a rechargeable battery to a bulb circuit and disconnecting the battery from a charging and indicating circuit when the plug unit is in the non-charging position. The switch unit also disconnects the battery from the bulb circuit and connects the battery to the charging circuit and indicating circuit when the plug unit is in the charging position. This document teaches that the plug unit can be rotated into and out of the body of the flashlight while remaining connected thereto.

Another flashlight is disclosed in U.S. Pat. No. 4,515,790 which has a rechargeable power pack or cartridge which discloses a plug structure for use with standard electricity sockets or supply outlets, whereas the power cartridge also has a shape which allows the plug structure to be utilised for example with a cigarette lighter outlet of a motor vehicle so that the user has the option of recharging from either electricity supply outlets or from a cigarette lighter outlet of a motor vehicle or a boat. The battery is removed from the flashlight as it is a part of the power pack for recharging purposes. The construction thus can result in the separation of the power pack from the flashlight during the recharging process, which will decrease the ready to use state of the flashlight by comparison to the flashlight disclosed in U.S. Pat. No. 5,847,540.

The applicant does not concede that the prior art discussed above forms part of the common general knowledge in the art of the skilled addressee that the priority date of this application.

SUMMARY OF THE INVENTION

The present invention provides a flashlight having: a body with a light means at one end, a battery, and a circuit therebetween, so that when said circuit is closed said light means will generate light; recharging terminals for recharging said battery and an adaptor having electrical connectors for connecting the adaptor to a power supply; structural connection means on said body and/or said adaptor to releasably connect said body and said adaptor; and electrical connection means on both said body and said adaptor to releasably electrically connect said terminals and said adaptor; said recharging terminals being able to be received in said adaptor and said electrical connectors being able to be received in said body when said adaptor is not in use for recharging.

The adaptor and the body have said structural connection means disconnected in order for said electrical connection means to electrically connect said terminals and said adaptor.

The structural connection means can include a female portion on one of said body or said adaptor, with the other having a male portion. The female portion or said male portion when present on said body has said electrical connectors extending therefrom. The female portion or the male portion of said adaptor has said electrical connectors extending therefrom.

The female portion or male portion said body can include cavities to receive said electrical connectors.

The female portion or male portion of said adaptor can include cavities to receive said terminals.

The adaptor can be shaped so that when said structural connection means connect said body and said adaptor, said adaptor is of a shape which substantially matches the shape of said body in the vicinity of said adaptor.

The adaptor can be shaped so that when said structural connection means connects said body and said adaptor is the rear part of the body.

The adaptor can include a socket to receive said recharging terminals.

When said electrical connectors are in a power supply socket with a vertically oriented front face, said adaptor can have an upper face into which said rechargeable terminals are inserted, the upper face being at an angle to the horizontal so that a line normal to the upper face extends away from the adaptor on a divergent path away from the vertical.

The body can have a female portion and said adaptor can have a male portion.

The male portion can be of a shape and or size to fit between said recharging terminals.

The adaptor can include a hinged cover to overlay said electrical connection means on said adaptor.

The hinged cover can act to limit movement of said flashlight on said adaptor when they are electrically connected.

The adaptor can have a first position relative to the body to enable recharging of the battery in which the recharging terminals are received in the adaptor, and another, second position relative to the body, for when the adaptor is not in use for recharging the battery, in which the electrical connectors are received in the body.

The present invention also provides a flashlight having a body with a light means at one end, a battery, and a circuit therebetween, so that when said circuit is closed said light means will generate light; said light means including a frusto-conical reflector having a central axis and a reflective surface projecting towards the axis, the reflective surface being straight when viewed in a cross-section of the reflector taken through the axis, a white light LED emitting a conical light output and a double convex lens portion, said double convex lens portion being located away from said LED so that the outside diameter of said double convex lens portion will be struck by a circle of light from said LED which is of substantially the same diameter.

Around said double convex lens portion can be a straight sided lens. The straight sided lens and said double convex lens portion can be integrally formed in a single lens member.

A flashlight as claimed in claim 28 wherein said light means produces a beam emitted from said flashlight which has four bands of differing light intensity.

Preferably there is a circular centre and at least three annular bands of light there around.

The circular centre preferably has the highest light intensity relative to said annular bands. The first band adjacent to said circular centre preferably has the lowest light intensity relative to said annular bands. The second band adjacent said first band preferably has a light intensity less than said circular centre but greater than said first band. The third band adjacent said second band can have a light intensity less than said second band but greater than said first band.

BRIEF DESCRIPTION OF THE DRAWINGS

An embodiment of the present invention, will be described by way of example only, with reference to the accompanying drawings, in which.

DETAILED DESCRIPTION OF THE EMBODIMENTS

Figure 1:
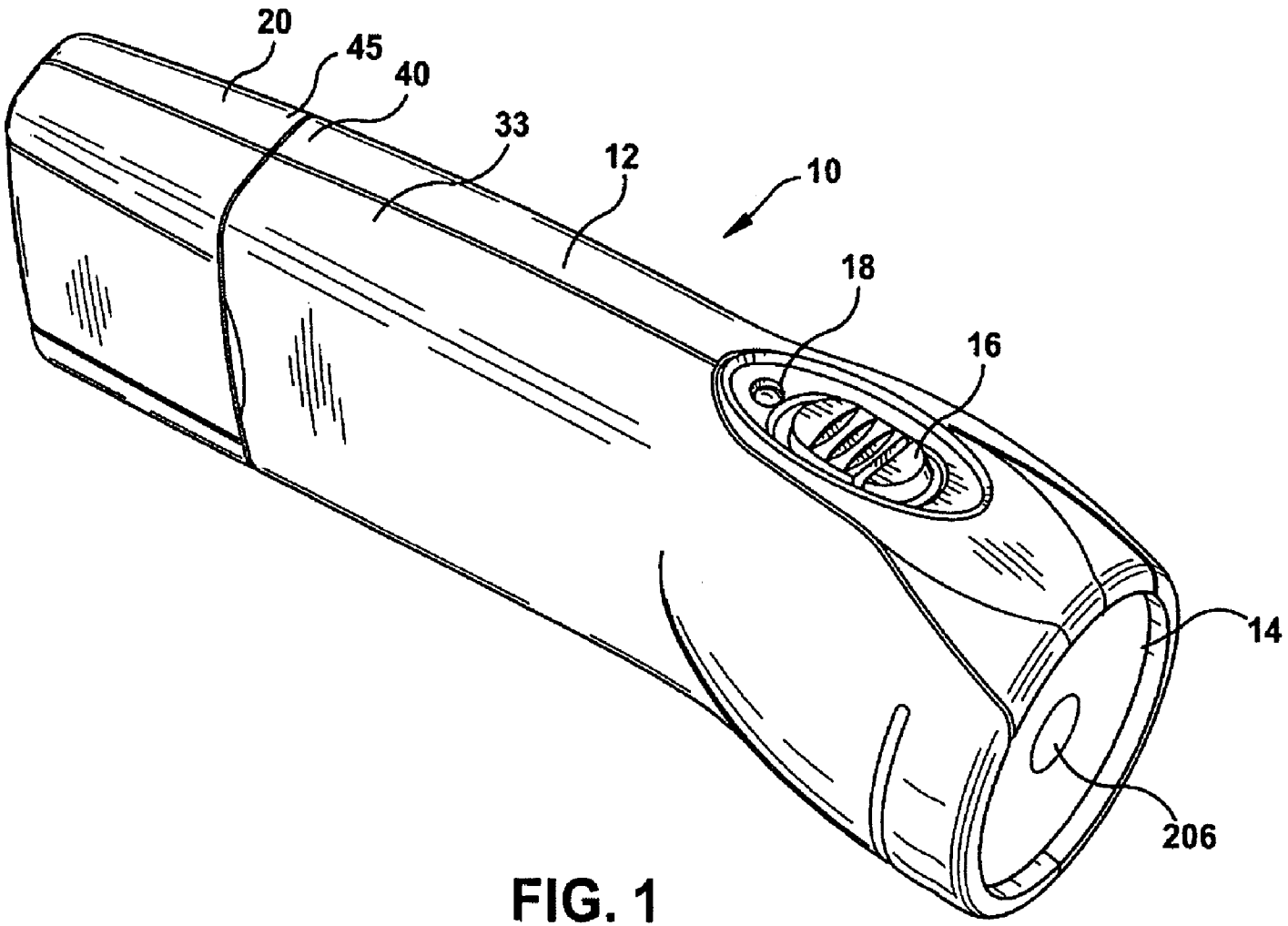
FIG. 1 illustrates a perspective view of a rechargeable flashlight.

Illustrated in FIG. 1 is a flashlight 10 which has a body 12 with a lens assembly 14 at its forward end. At the top of the body 12 is a three position switch 16 and a red LED 18 positioned behind the switch 16.

At the rear of the body 12 is located an adaptor 20. Illustrated in FIG. 3 the adaptor 20 has two electrical connectors 22 and 24 for insertion into a wall socket. The format of the electrical connectors 22 and 24 are to suit the spacing and shape required for European wall sockets and it will be understood that the shape and spacing of these can be varied according to requirements in various countries around the world.

The connectors 22 and 24 extend away from a hexagonally shaped male portion 26 which has cut aways 28 and 30 on opposite sides leading to a recess 32 shown on the right side with a similar recess which is not visible on the left. (A left recess is visible in FIG. 5 and is labelled with the numeral 73.) The right side 34 of the adaptor 20 as illustrated in figure 3 will become the upper surface of the adaptor 20 when the adaptor 20 is in use in a wall socket as illustrated in FIG. 4.

Figure 5:
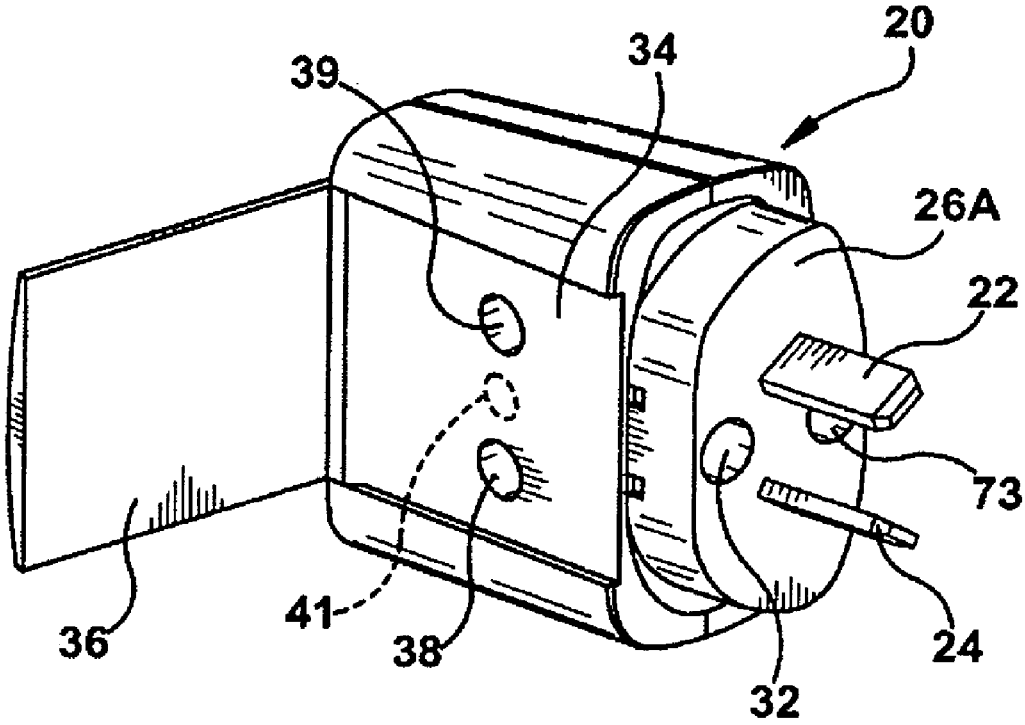
FIG. 5 illustrates an adaptor similar to FIG. 3 with a cover in the open position.

The side 34 has a rotating cover 36 which covers and protects the sockets 38 and 39 in the adaptor 20. In FIG. 5 the cover 36 is rotated to the open position.

Figure 3:
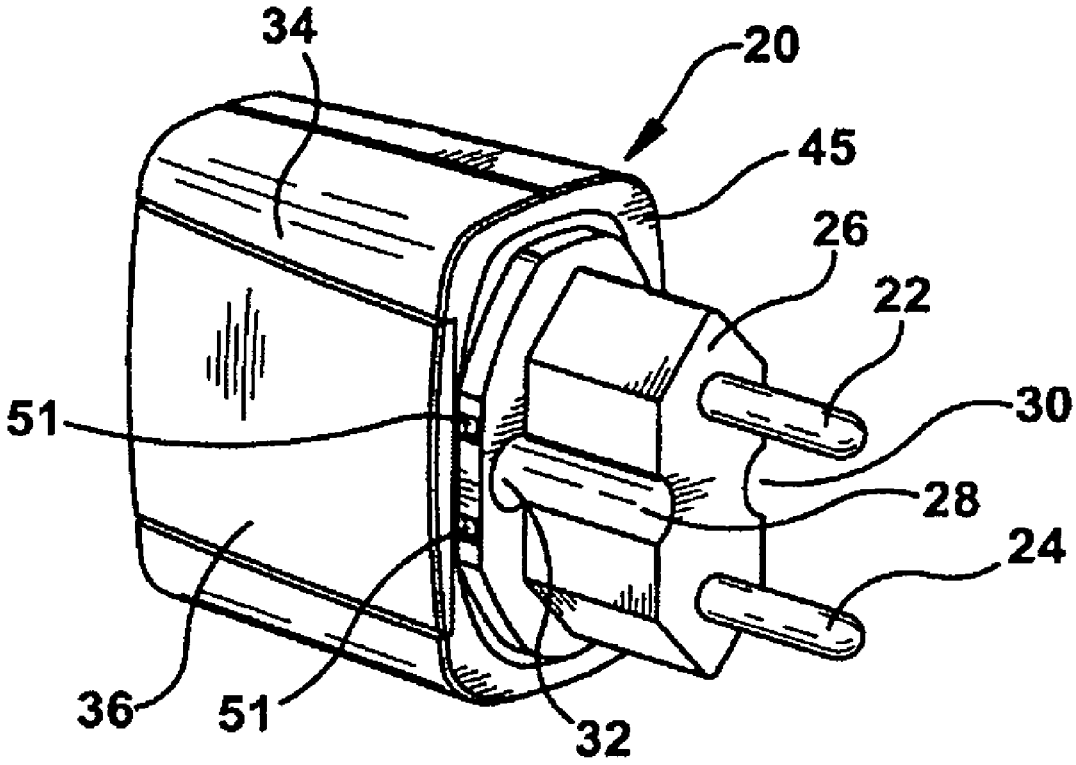
FIG. 3 illustrates a front perspective view of the rear adaptor of the flashlight of FIG. 1.
Figure 4:
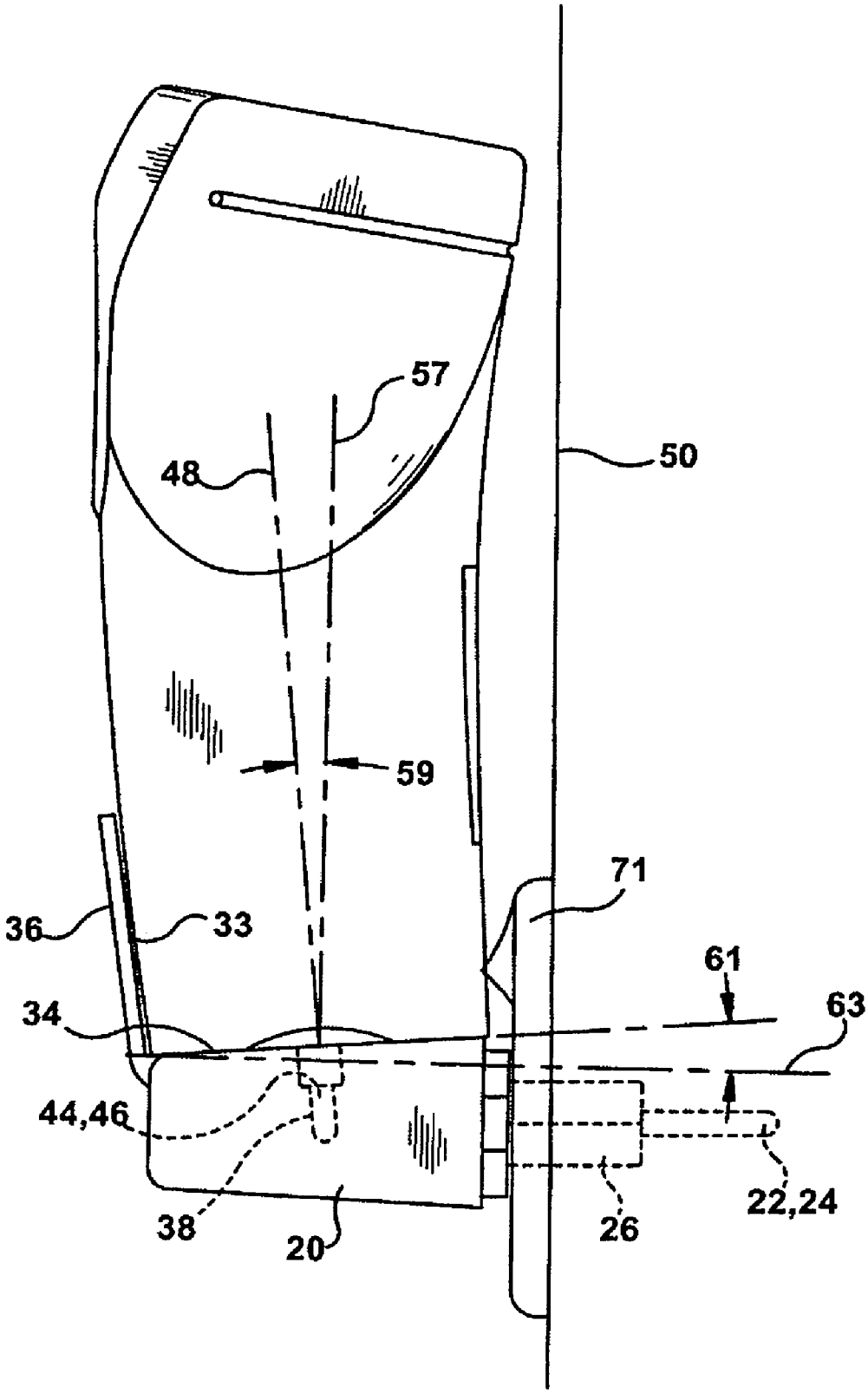
FIG. 4 illustrates the flashlight of FIG. 1 mounted on the adaptor and positioned in an electricity socket.

As can be seen from FIGS. 1 and 3, the shape of the adaptor 20 with the cover 36 closed, complements and finishes the rear of the flashlight body 12. The lines and starting point of the outward surfaces of the front 45 of the adaptor 20, blend with the lines and finishing point of the outward surfaces of the rear 40 of the flashlight body 12.

The rear 40 of the flashlight body 12 has a cavity 42, which has a complementary shaped hexagonal recess 43 to receive the hexagonal male portion 26 of the adaptor 20. The recess 43 receives the male portion 26 therein whilst the cavities 32 (and 73) at the sides of the hexagonal male portion 26 receive therein recharging terminals 44 and 46 which are of a generally cylindrical shape, and which project outwardly from the cavity 42. The hexagonal male portion 26 has shallow recesses 51 so that complementary shaped protrusions 53 on the cavity 42 can sit therein to lock the adaptor 20 and body 12 together, until sufficient force is applied to separate the two components.

While the above discussion and FIGS. 1, 2, 3 and 4 utilise a recess 43 and male portion 26 which are generally hexagonal in shape, this hexagonal shape is only a preferment. As can be seen from FIG. 5, a different shaped male portion 26A is used.

As can be seen from FIG. 4, the side 34, when in situ in a wall socket is upwardly facing. It will also be noted from the side elevation of FIG. 4, that an imaginary line 48, which is normal or perpendicular to the side 34, divergently extends away from the adaptor 20, at an angle 59 from the vertical 57 represented by the wall 50, to which the socket 47 is attached.

This angle 59 also has the same magnitude as the angle 61 which is the angle between the side 34 and the horizontal 63, as shown in FIG. 4.

The angles 59 and 61 are approximately 8° but can be in the range of 5° to 30°. This angle allows the flashlight body, to rest on the adaptor 20 in an equilibrium condition due to the flashlight body 12 having a contoured forward end whereby the lighting means and lens assembly 14 are oriented at an angle to the longitudinal axis of the rest of the flashlight body 12. The cover 36 also opens outwardly to an angle of similar magnitude as angle 59, so as to provide support to the rear end 40 of the flashlight body 12, by engaging the face 33, which is located on the top (when the flashlight is in the orientation of FIG. 1) of the body 12. This helps to keep the flashlight 10 in position on the adaptor 20 and limits the movement which may separate the flashlight 10 from the adaptor 20. The movement is thus limited to a side to side movement, generally parallel to the wall 50 in which the power socket is located, and not toward or away from the wall 50.

Once the adaptor 20, is located in a power socket 71 which is then switched on, then the rechargeable batteries in the flashlight 10 will be recharged.

During recharging the LED will switch on intermittently. Once full recharging has occurred, the LED will be lighted continuously.

Once recharging has occurred, the flashlight can be simply taken off the adaptor 20, and is useable without the adaptor 20 being reconnected to the rear of the flashlight.

However, for aesthetic purposes the adaptor 20 can be reconnected to the rear 40 of the body 12.

The two position switch 16 has an intermediate off position and a first on position which lights the lamp means with a low level current. The second on position will light the lamp means with a relatively high level current.

The lamp means is preferably provided by means of 1 or more LEDs.

By using LED's the flashlight will have a relatively long run time before the rechargeable batteries are drained.

Alternatively other type of lamp means can be utilised.

Figure 2:
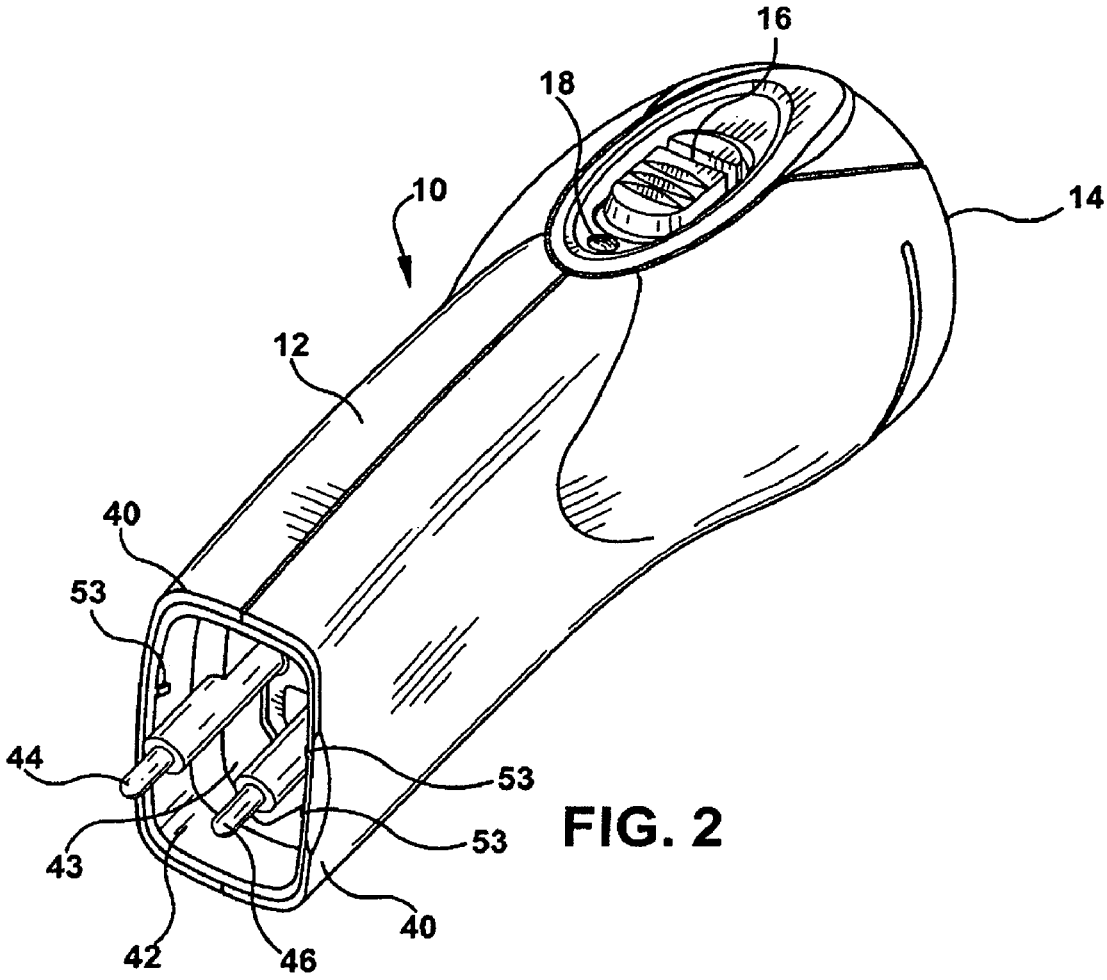
FIG. 2 illustrates a rear perspective view of the flashlight of FIG. 1 with the rear adaptor removed.
Figure 9:
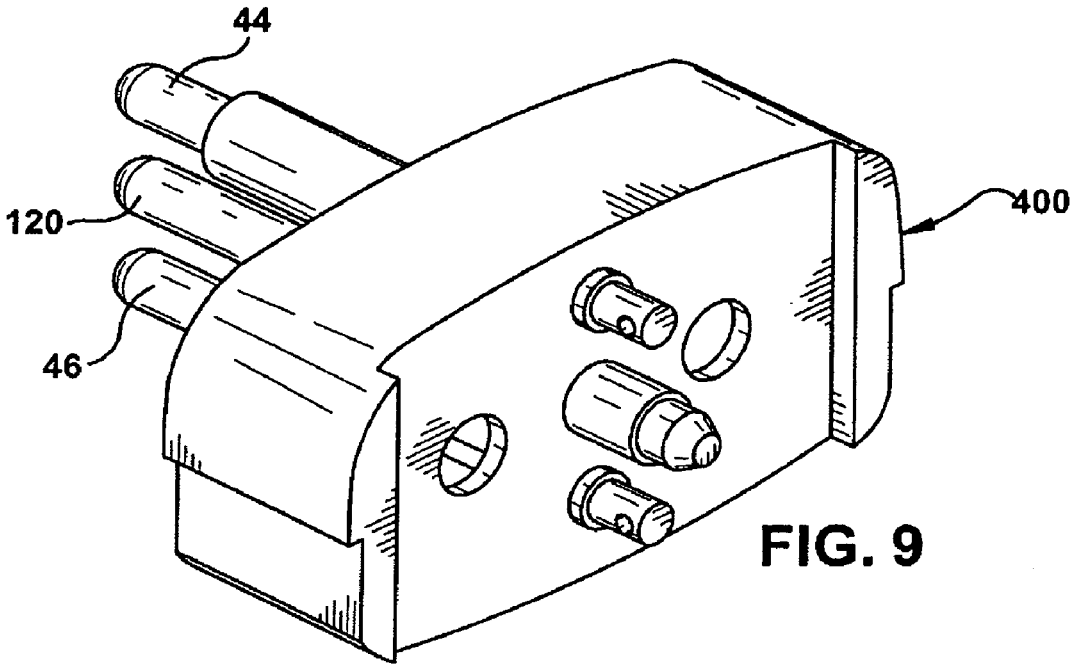
FIG. 9 illustrates a perspective view of a flashlight body's end having three pins.
Figure 10:
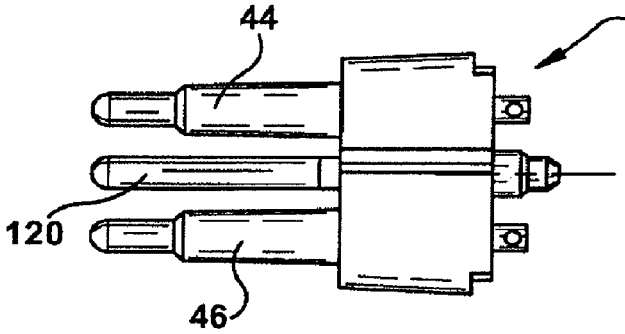
FIG. 10 is a side elevation of FIG. 9.
Figure 11:
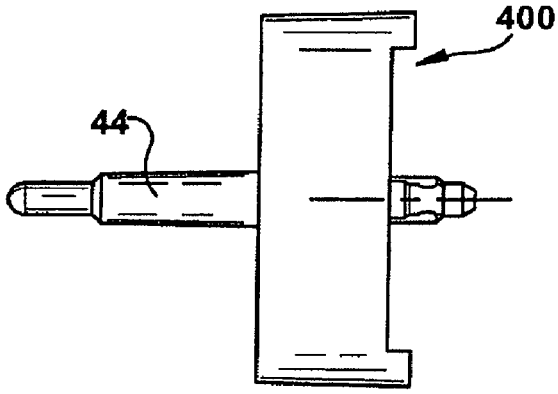
FIG. 11 is a plan view of FIG. 9.

As can be seen in FIG. 2, the flashlight 10 has the two terminals 44 and 46 extending away from the rear thereof. The terminals 44 and 46 are mounted in and extend away from a plug member which is assembled, captured and held by the rear end of the flashlight 10 when it is assembled. However, in another embodiment, an alternative plug member 400 as illustrated in FIG. 9 to 11 can be utilised for assembly into, capture and holding by the rear end of the flashlight 10. The plug 400 includes the terminals 44 and 46, as well as an additional central pin 120. The pin 120 will prevent a terminal 44 or 46 from being inserted into an aperture 38 or 39 in such a manner that would otherwise have had the other terminal 46 or 44 exposed on the outside of the adaptor 20. The pin 120 performs this preventative task because unless the terminals 44 and 46 and pin 120 are aligned with apertures 38 and 39 and a third aperture 41 (see FIG. 5) then the terminals 44 and 46 will not individually be able to enter the adaptor 20.

Other means to prevent improper use can be provided such as shutters 100 and 130 in FIGS. 6 and 7, which will now be described.

Figure 6:
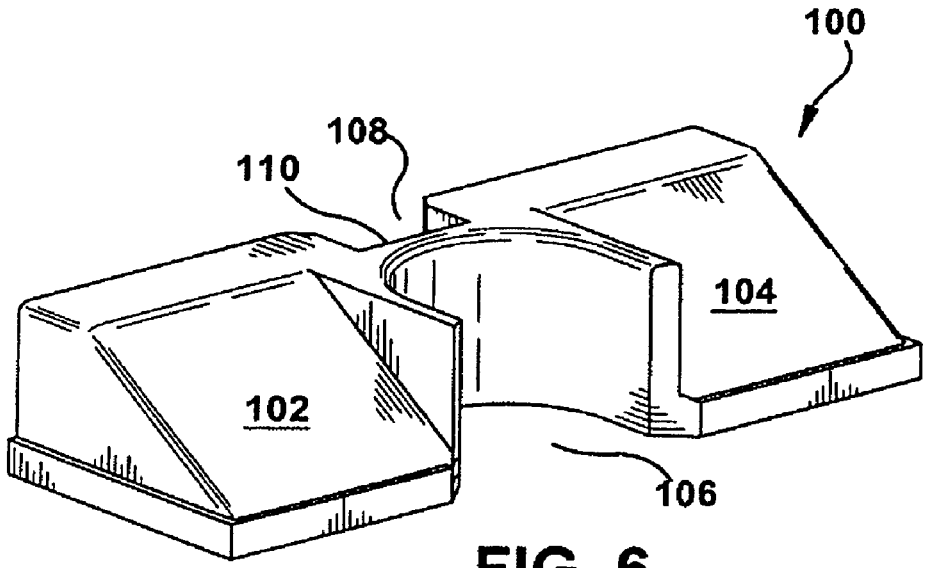
FIGS. 6 and 7 illustrate perspective views of shutter members.

Illustrated in FIG. 6 is a shutter member 100 for use with a flashlight having a plug 400 of FIGS. 9 to 11. The shutter 100 has two angled faces 102 and 104 at its ends. The angle on the faces 102 and 104 is approximately 45° to the base of the shutter 100. Between the angled faces 102 and 104 is a bight 106. The faces 102 and 104 will be engaged by terminals 44 and 46 on the flashlight 10, whereas the bight 106 can receive central third pin 120. Behind the bight 106 is a three sided recess 108 which has a central face 110. The face 110 and recess 108 receives the end of a compression spring 114 (see FIG. 8) and provides a bearing surface for the end of the spring 114 to push against.

Figure 8:
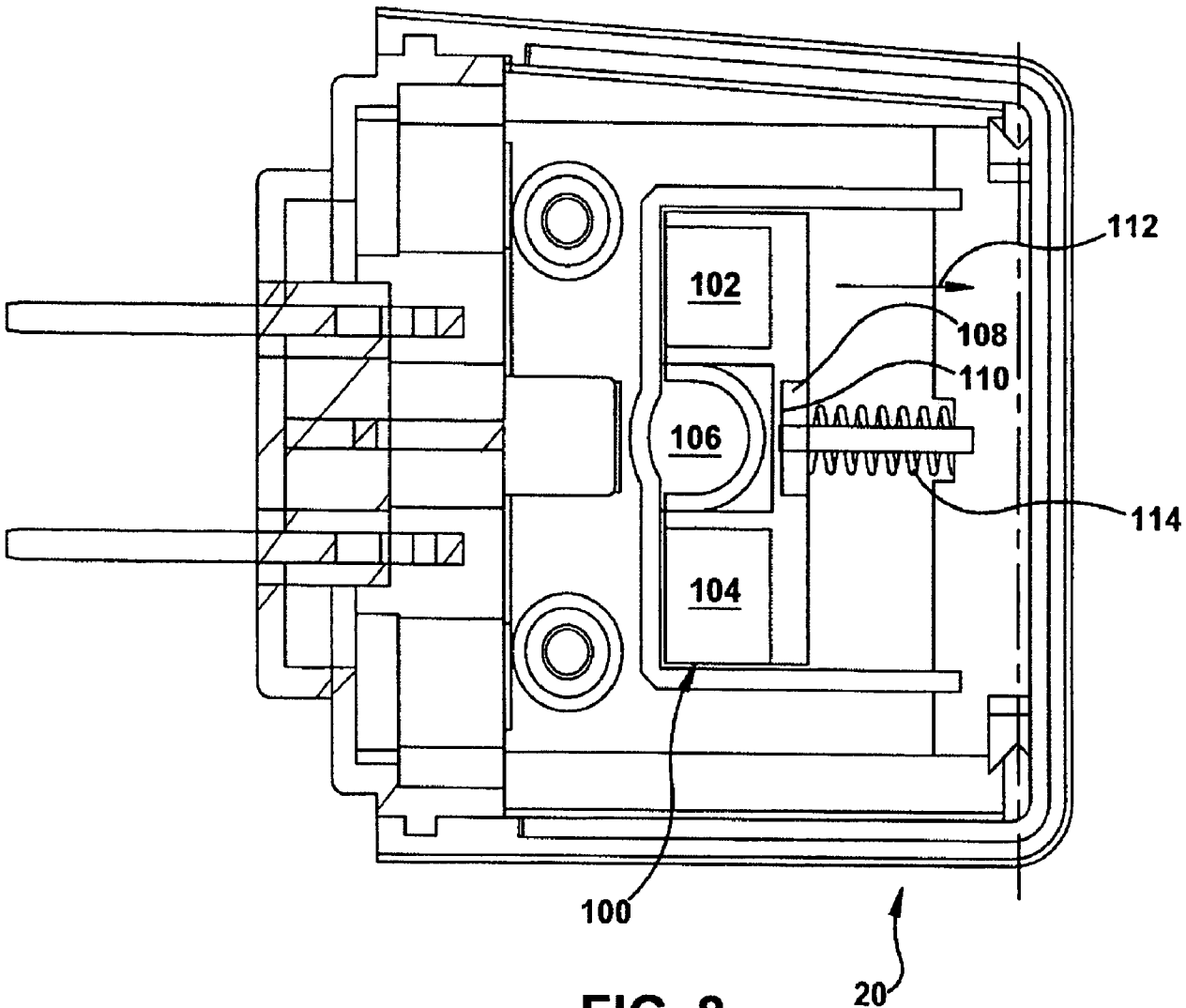
FIG. 8 illustrates the shutter member of FIG. 6 assembled into an adaptor.

The shutter member 100 can be made of injection moulded plastic and located or assembled in the adaptor 20 as illustrated in FIG. 8 so that the faces 102 and 104 overlie the contacts (no illustrated) which will be engaged by terminals 44 and 46. The shutter system 100 can be utilised with a flashlight similar to that of FIG. 2 having only two terminals (44 and 46) but it is thought to be best used with a flashlight having three pins: namely terminals 44 and 46 and central pin 120 (see FIGS. 9, 10 and 11).

The terminals 44 and 46 will pass through apertures 38 and 39 in the adaptor 20 while pin 120 will pass through a central aperture 41 (see FIG. 5 where it is indicated in dashed linework). The terminals 44 and 46 will engage the surfaces 102 and 104 respectively to thereby push the shutter 100 in a rearward direction 112 against the bias of the spring 114 which is illustrated in FIG. 8. As the shutter 100 moves in the direction of arrow 112 further pushing of the rear of the flashlight 10 towards the adaptor 20 will mean that the shutter 100 will move completely out of the way of the terminals 44 and 46 allowing the terminals 44 and 46 ultimately push past the shutter 100 so as to engage the contacts located below the shutter 100. As the terminals 44 and 46 are moving inward, the pin 120 will simultaneously pass through the central aperture 41 and into the bight 106 which will not interfere with the movement of the shutter 100 in the direction of 112.

When the terminals 44 and 46 push past the shutter 100 and engage the contacts below the shutter 100 the recharging process can begin once the adaptor 20 is inserted into a power socket, which can then be switched on.

Figure 7:
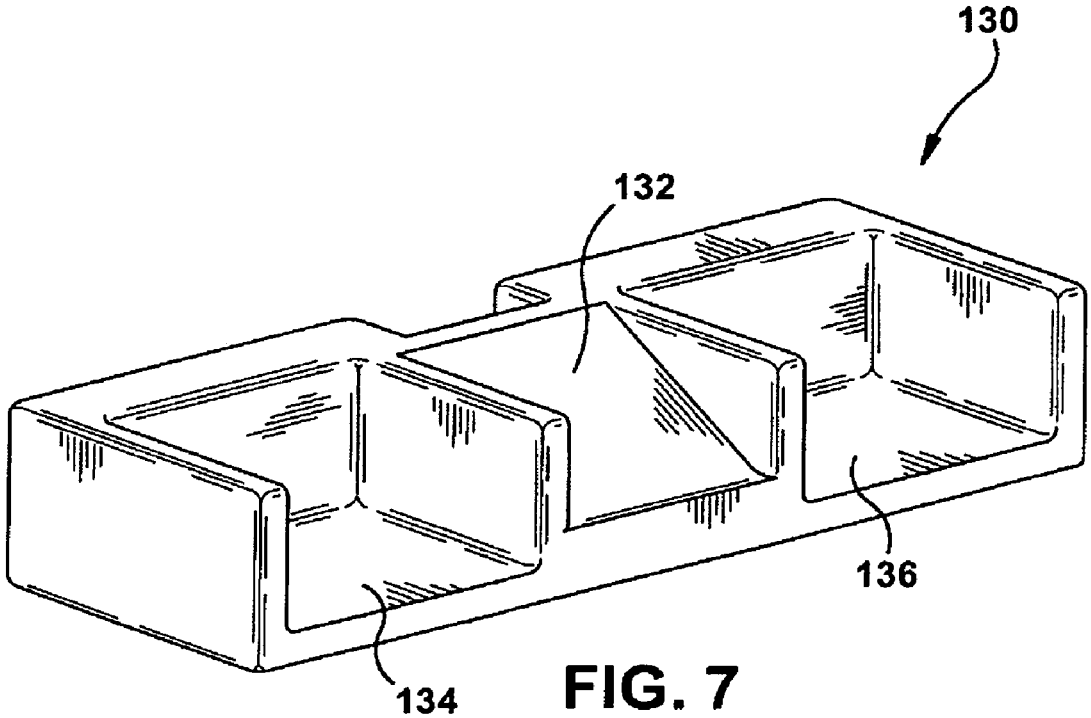

Illustrated in FIG. 7 is another shutter 130 which has only a central angled face 132 (being at an angle of approximately 45° to the base of the shutter 130) and flat faces 134 and 136 on either side thereof. The shutter 130 operates in much the same manner as the shutter 100 except that the shutter 130 will move in the direction of arrow 112 only when the central pin 120 engages the angled face 132. Thus should the pin 120 fracture or otherwise break the terminals 44 and 46 will not cause the shutter 130 to move in the direction 112, as they will perpendicularly engage the flat faces 134 and 136, thereby preventing access to the contacts below the shutter 130. Contrasted with this the shutter 100 of FIG. 6 will continue to perform even if the central pin 120 were not present, as the shutter 100 will still move in the rearward direction 112. Thus the shutter 130 is inherently better in operation than the shutter 100.

The central pin 120 if utilised with a shutter 100 serves the purpose of preventing the terminal 44 or 46 from being placed into one of the apertures 38 or 39 with the other terminal 46 or 44 being left in an exposed condition outside of the adaptor 20. However, in an embodiment which utilises the shutter 130, the central pin 120 has the additional purpose of moving the shutter 130 to its open condition allowing the terminals 44 and 46 to gain access to the contacts located underneath the shutter.

Figure 12:
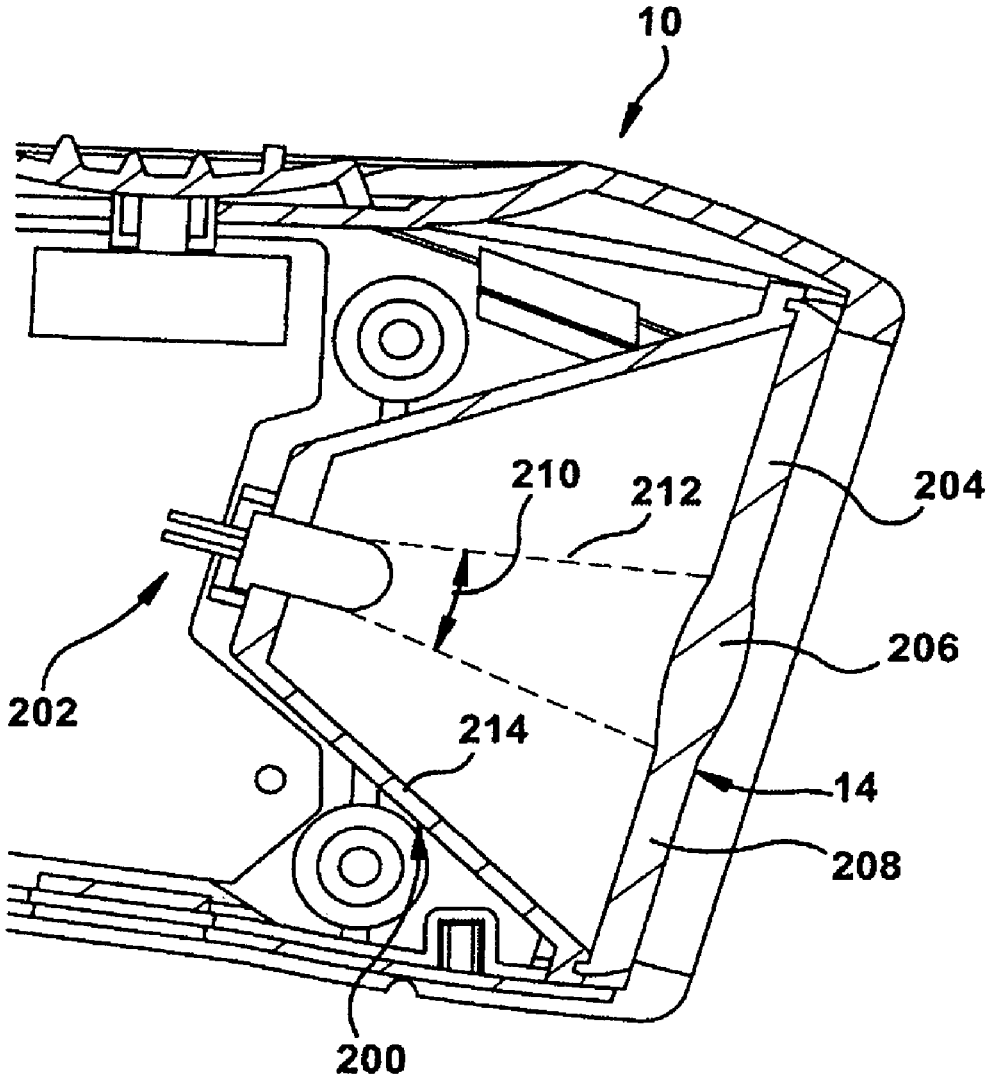
FIG. 12 is a cross section through the forward end of the flashlight of FIG. 1.

Illustrated in FIG. 12 is a cross section through the reflector and lens assembly 14 of flashlight 10 of FIG. 1. As can be seen from FIG. 12 flashlight 10 has a lens assembly 14 which consists of a conical reflector 200 in which is centrally positioned a white LED 202. The lens assembly 14 also includes a lens 204 which has a double convex central lens portion 206 (which can also be seen in FIG. 1) surrounded by an annular straight sided lens portion 208. The lens 206 is positioned at a suitable distance from the LED 202 so that when the cone angle 210 of the LED 202 is taken into consideration, the outside diameter of the double convex lens portion 206 is positioned away from the LED 202 so that it will be struck by the cone of light 212 when the cone has a diameter of substantially the same dimension as the diameter of the lens 204. The annular straight sided portion 208 of the lens 204 will transmit the light from LED 202 which is reflected off the walls 214 of conical reflector 200. This will produce the effect of a concentrated central beam with a less bright halo concentrically arranged around the centre of the central beam.

Figure 13:
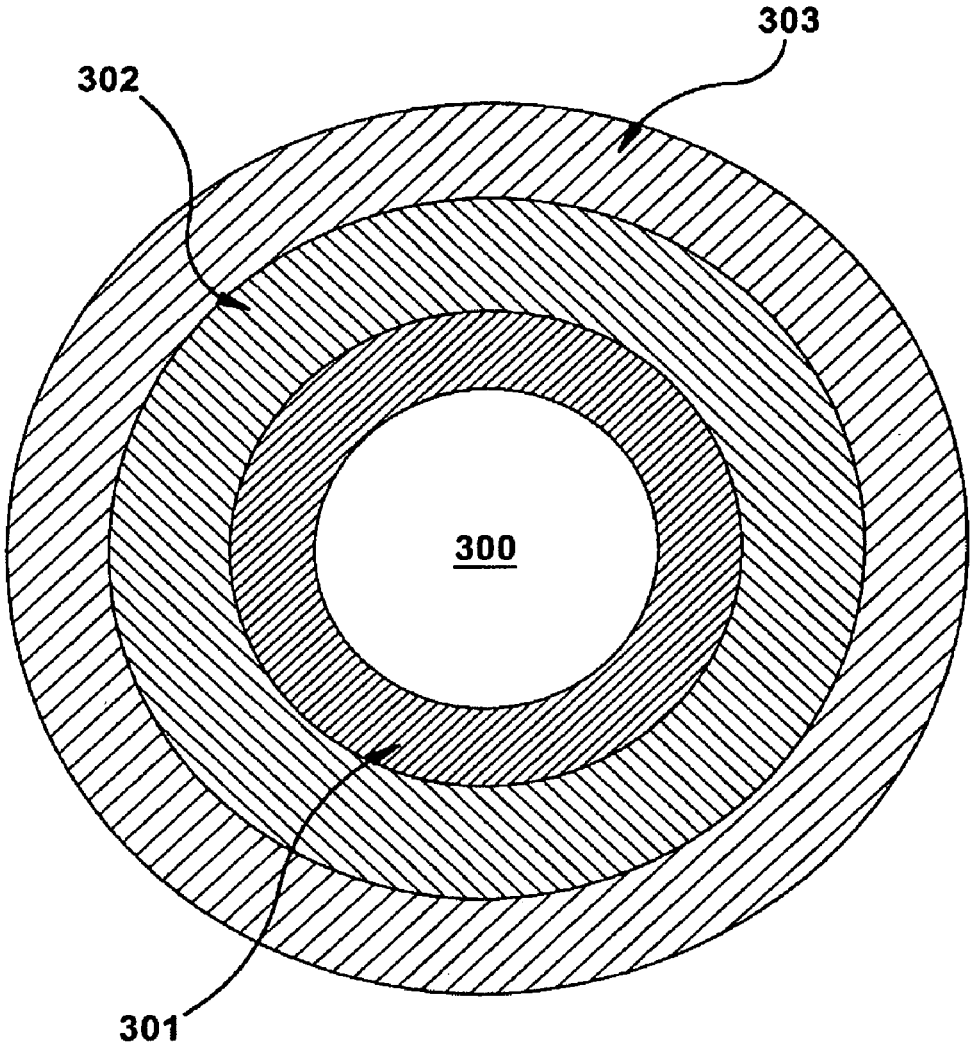
FIG. 13 is a schematic representation of the light output of the lens assembly of FIG. 12.

It has also been noticed that this reflector and lens assembly 14 will produce a series of concentric rings as illustrated in FIG. 13, whereby the centre portion 300 is the brightest with at least three annular bands 301, 302 and 303 around the centre 300. The first annular band 301 is a relatively dark ring (darker than the outer two annular bands 302 and 303 and the centre portion 300). The second annular band 302 is brighter than the third annular band 303, but is of less intensity than the centre portion 300. This effect has been found to produce a useful light output even though only relatively little power is being consumed from the power source.

The bands 301, 302 and 303 are illustrated as being homogenous, however, in practice the bands 301, 302 and 303 may be interspersed with flecks of light or possibly thin lines of light.

Due to the power plug requirements of some countries, the adaptor used may need to be of a shape and size which will not permit the adaptor to be attached, when not in use, to the rear of the flashlight. Thus such an adaptor can be stored separately from the flashlight, with an end cap being provided to cover the terminals 44 and 46 at the rear of the flashlight, when recharging is not required. While some of the features of the adaptor 20 would not be required on such an adaptor, such an adaptor can include the shutter systems described above to attempt to prevent misuse.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

The invention claimed is:

1. A flashlight having:

a body with a light means at one end, a battery, and a circuit therebetween, so that when said circuit is closed said light means will generate light;

recharging terminals for recharging said battery and an adaptor having electrical connectors for connecting the adaptor to a power supply;

structural connection means on said body and/or said adaptor to releasably connect said body and said adaptor; and electrical connection means on both said body and said adaptor to releasably electrically connect said terminals and said adaptor, said recharging terminals being able to be received in said adaptor and said electrical connectors being able to be received in said body when said adaptor is not in use for recharging.

2. A flashlight as claimed in claim 1 wherein said adaptor and said body have said structural connection means disconnected in order for said electrical connection means to electrically connect said terminals and said adaptor.

3. A flashlight as claimed in claim 1, wherein said structural connection means includes a female portion on one of said body or said adaptor, with the other having a male portion.

4. A flashlight as claimed in claim 3 wherein said female portion or said male portion when present on said body has said electrical connectors extending therefrom.

5. A flashlight as claimed in claim 4 wherein said female portion or male portion of said body includes cavities to receive said electrical connectors.

6. A flashlight as claimed in claim 3 wherein said female portion or said male portion of said adaptor has said electrical connectors extending therefrom.

7. A flashlight as claimed in claim 6 wherein said female portion or male portion of said adaptor includes cavities to receive said terminals.

8. A flashlight as claimed in claim 6 wherein said adaptor is shaped so that when said structural connection means connect said body and said adaptor, said adaptor is of a shape which substantially matches the shape of said body in the vicinity of said adaptor.

9. A flashlight as claimed in claim 8 wherein said structural connection means includes a formation which will allow said adaptor to be attached to said body in only one orientation.

10. A flashlight as claimed in claim 8 wherein said structural connection means includes a formation which will allow said adaptor to be attached to said body in one of two possible orientations.

11. A flashlight as claimed in claim 3 wherein said body has a female portion and said adaptor has a male portion.

12. A flashlight as claimed in claim 11 wherein said male portion is of a shape and or size to fit between said recharging terminals.

13. A flashlight as claimed in claim 1 wherein said adaptor is shaped so that when said structural connection means connects said body and said adaptor, said adaptor is the rear part of the body.

14. A flashlight as claimed in claim 1 wherein said adaptor includes a socket to receive said recharging terminals.

15. A flashlight as claimed in claim 14 wherein said adaptor includes a shutter to cover contacts used to recharge said flashlight.

16. A flashlight as claimed in claim 15 wherein said shutter is spring biased to a closed condition.

17. A flashlight as claimed in claim 15 wherein said shutter is adapted to be moved to an open condition by means of one or two pins on said flashlight.

18. A flashlight as claimed in claim 17 wherein said shutter includes three regions to interact with a respective pin on said flashlight.

19. A flashlight as claimed in claim 18 wherein a central region includes an angled face to be engaged by a central pin on said flashlight to thereby assist said pin to push said shutter from a closed position to an open position.

20. A flashlight as claimed in claim 19 wherein a region on either side of said central region includes a face perpendicular to the direction of movement of said pins into or out of said adaptor said face being adapted to prevent said shutter from moving when a pin contacts said face.

21. A flashlight as claimed in claim 18 wherein a central region includes a bight through which a central pin can pass.

22. A flashlight as claimed in claim 21 wherein there is a region on either side of said central region which includes an angled face to assist pins on said flashlight to push said shutter from a closed position to an open position.

23. A flashlight as claimed in claim 1 wherein when said electrical connectors are in a power supply socket with a vertically oriented front face, said adaptor has an upper face into which said rechargeable terminals are inserted, the upper face being at an angle to the horizontal so that a line normal to the upper face extends away from the adaptor on a divergent path away from the vertical.

24. A flashlight as claimed in claim 1 wherein said adaptor includes a hinged cover to overly said electrical connection means on said adaptor.

25. A flashlight as claimed in claim 24 wherein said hinged cover acts to limit movement of said flashlight on said adaptor when they are electrically connected.

26. A flashlight as claimed in claim 1 wherein between said recharging terminals there is located a central pin which is as coextensive as said terminals.

27. A flashlight as claimed in claim 26 wherein said adaptor and said body receives said central pin when making a structural or electrical connection.

28. A flashlight as claimed in claim 1 wherein said adaptor has a first position relative to the body to enable recharging of the battery in which the recharging terminals are received in the adaptor, and another, second position relative to the body, for when the adaptor is not in use for recharging the battery, in which said electrical connectors are received in said body.

* * * * *